US005944294A

United States Patent [19]

Baer

[11] Patent Number: 5,944,294

[45] Date of Patent: Aug. 31, 1999

[54] MOUNTING DEVICE IN FORM OF C-CLAMP MOUNTED SPACE FROM A WALL

[76] Inventor: Thomas C. Baer, 27 Purdy St., Harrison, N.J. 10528

[21] Appl. No.: 09/110,867

[22] Filed: Jul. 6, 1998

[51] Int. Cl.[6] ..... A47K 1/00

[52] U.S. Cl. ..... 248/220.43; 248/222.11

[58] Field of Search ..... 248/222.11, 220.43, 248/222.12, 222.13, 222.51, 229.16, 231.81; 52/506.05

[56] References Cited

U.S. PATENT DOCUMENTS

| | | | |
|---|---|---|---|
| 2,576,950 | 12/1951 | Pratt . | |
| 2,665,869 | 1/1954 | Samuels | 248/214 |
| 2,692,054 | 10/1954 | Berglund | 211/106.01 |
| 3,135,490 | 6/1964 | Kirlin . | |
| 4,211,379 | 7/1980 | Morgan et al. | 248/222.21 |
| 4,304,382 | 12/1981 | Jelen | 248/221.11 |
| 4,311,295 | 1/1982 | Jamar et al. | 248/221.31 |
| 4,508,231 | 4/1985 | Honickman | 211/199 |
| 4,771,974 | 9/1988 | Carlson | 248/231.81 |
| 5,018,323 | 5/1991 | Clausen | 52/36 |
| 5,224,610 | 7/1993 | Veazey | 211/87 |
| 5,390,462 | 2/1995 | Kreiter | 52/506.05 |

*Primary Examiner*—Ramon O. Ramirez
*Attorney, Agent, or Firm*—Charles E. Temko

[57] ABSTRACT

A mounting device for use in conjunction with grooved wallboard to mount implement-holding devices, which, in turn, support tools and implements. When installed, the device is in spaced parallel relation to the outer surface of the wallboard to allow mounting of a holding device for a stored implement.

6 Claims, 2 Drawing Sheets

FIG. 1
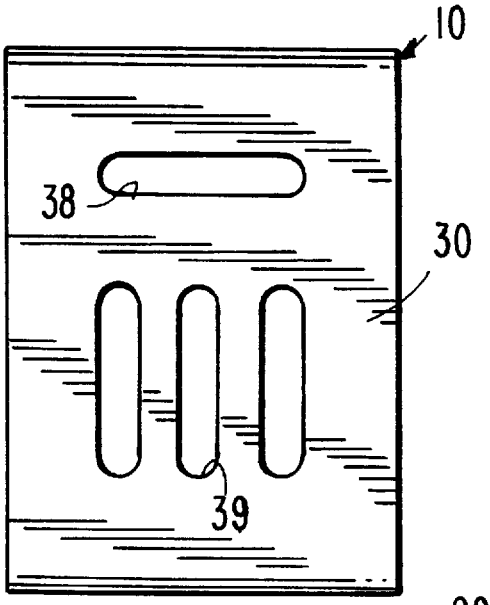
FIG. 2
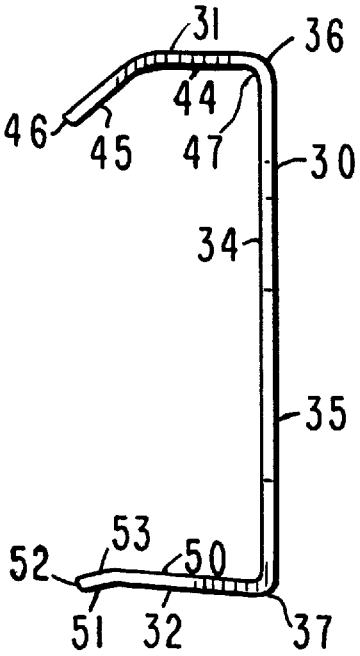
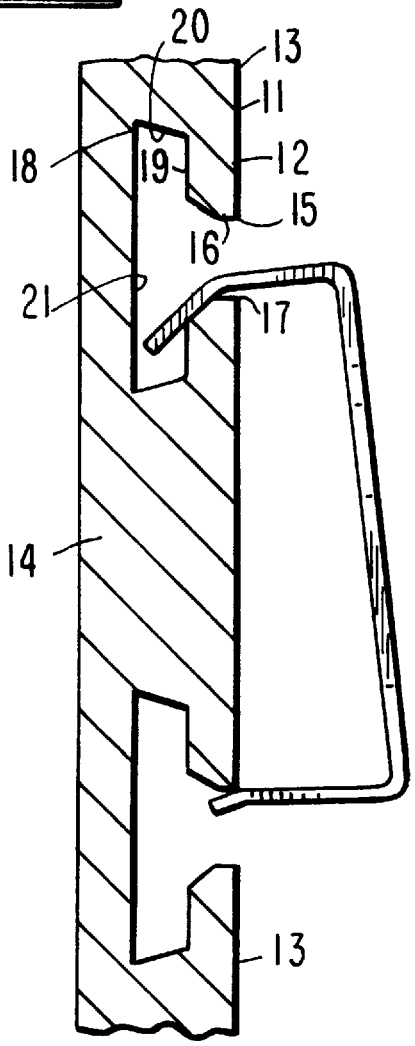
FIG. 3

MOUNTING DEVICE IN FORM OF C-CLAMP MOUNTED SPACE FROM A WALL

BACKGROUND OF THE INVENTION

This invention relates generally to the field of mounting hardware, and more particularly to an improved resilient clip for mounting various devices upon the exposed surface of a building wall panel as might be located in a garage or storage shed in such manner that it may be manually removed for subsequent repositioning at another desired location.

In typical enclosed areas, such as an automobile garage, it is common to store various implements and tools upon a vertical wall surface in order to provide a clear floor for the storage of vehicles. This is usually accomplished by installing a nail or hook-like holder upon which the tool or implement is detachably supported. Successive installations of such tools often make necessary the relocation of the holder in order to obtain greater wall space utilization, and it is not uncommon to reposition a particular holder several times on available wall space as more tools accumulate. This procedure usually requires removal of the hook or nail, and reinstallation of the same at the new location.

This process is made easier by using so-called pegboard sheets which provide a series of uniformly spaced holes, one or more of which are penetrated by any of a variety of hooks or other holding devices which support a particular implement for storage. There also exists in the prior art, specialized holding devices, for example, wedge-type supports for an elongated shaft or handle of a broom, this device being mounted upon the wall panel by threaded means. Repositioning such devices is likewise relatively time consuming.

Wallboard materials presently available include a fibrous construction of relatively thick cross section, in which an outer surface is provided with a plurality of parallel horizontally oriented grooves, the grooves forming a dovetail recess of trapezoidal cross section. These grooves permit the mounting of holding devices using nuts and bolts and accompanying washers, and a degree of horizontal adjustment is available by loosening the bolts and sliding the holding device horizontally within the dovetail groove. However, relocating the device to another groove requires complete removal of the same.

SUMMARY OF THE INVENTION

Briefly stated, the invention contemplates the provision of an improved resilient mounting device which eliminates the use of threaded means to attach the same to grooved wallboard of the type described, which may be employed singly or in combination with other similar devices to mount known implement holding devices which, in turn, support tools and implements. The disclosed device includes a planar main body member having first and second ends. A first end includes a hook-like member extending laterally thereof which engages an upper of two adjacent grooves in the wallboard, and a second end includes a laterally extending resilient terminal which engages the lower of the two adjacent grooves. When installed, the main body is in spaced parallel relation to the outer surface of the wallboard to allow screw, nut and bolt, or tab mounting of a holding device for the stored implement. The two interconnected devices are removed as a unit by merely pulling the resilient end free of engagement with the lower groove, and lifting the hooked opposite end from engagement, following which the unit may be reinstalled at a desired location by merely again engaging the hooked end and pressing the resilient end into position.

BRIEF DESCRIPTION OF THE DRAWINGS

In the drawings, to which reference will be made in the specification, similar reference characters have been employed to designate corresponding parts throughout the several views.

FIG. 1 is a front elevational view of an embodiment of the invention.

FIG. 2 is a side elevational view thereof.

FIG. 3 is a similar side elevational view thereof showing the embodiment in partially engaged condition with a grooved wallboard panel.

DETAILED DESCRIPTION OF THE DISCLOSED EMBODIMENT

Figure 5:
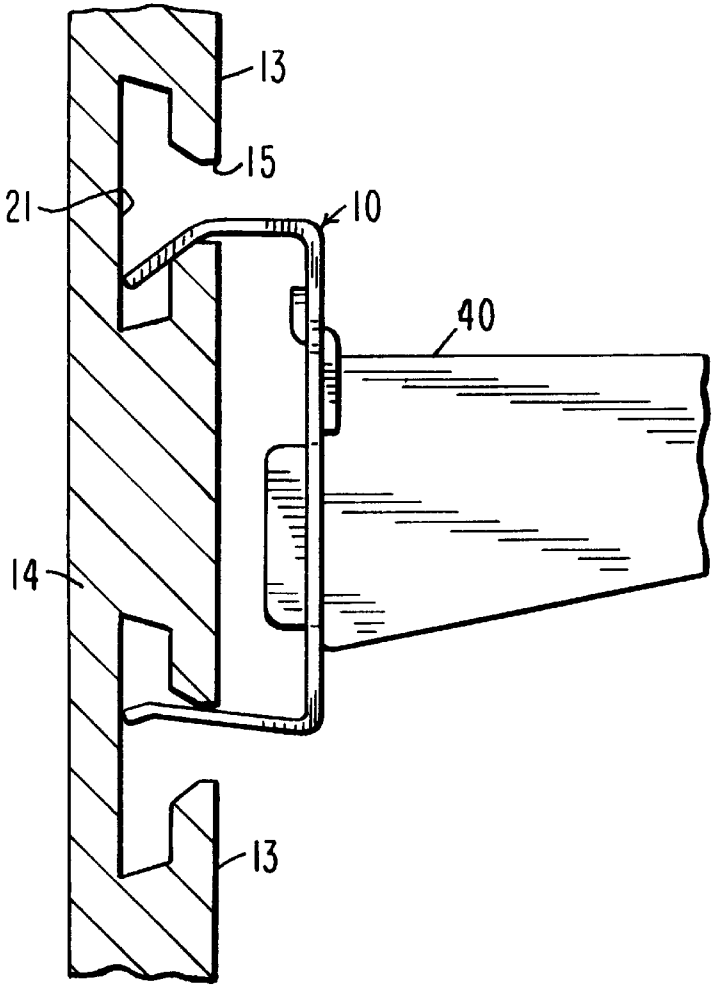
FIG. 5 is a side elevational view of the embodiment with an attached holding device.
Figure 4:
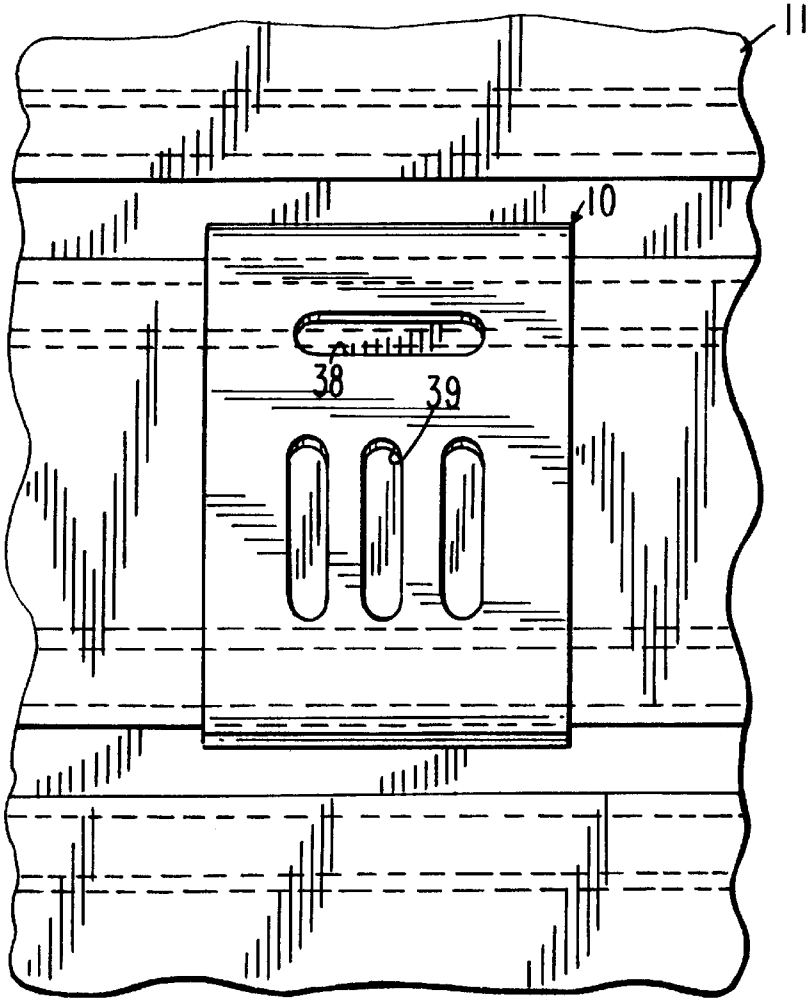
FIG. 4 is a front elevational view showing the embodiment in engaged condition with a wallboard panel.

In accordance with the invention, the device, generally indicated by reference character 10, is used in conjunction with a known type of wallboard panel 11 (see FIGS. 3 and 4). The panel 11 includes a planar inner surface 12 comprising a plurality of segmented surfaces 13 approximately three inches in width. The surfaces 13 are supported on individual segments 14 of the panel to define a series of spaced parallel slots 15 bounded by first and second edges L6 and 17 including inner angled portions thereof. The slots communicate with trapezoidally-shaped recesses 18 bounded by an inner surface 19, side surfaces 20 and bottom surface 21. In the prior art, it is known to utilize the dovetail recesses for mounting articles by means of nuts and bolts and an accompanying washer (not shown) wherein the installation is of a semi-permanent nature. To remove such installation, it is necessary to unthread the nut and bolt. To reinstall, the nut and bolt must be re-engaged, and the bolt inserted into a slot at an end terminal thereof.

Referring to FIGS. 1 and 2, the device 10 is preferably in the form of a generally "C"-shaped metallic clip which may be formed as a stamping from sheet metallic stock. It includes a rectangular planar main body 30, an upper hook-shaped member 31, and a lower resilient member 32.

The main body 30 is bounded by an inner surface 34 and an outer surface 35 as well as an upper edge 36 and lower edge 37. Penetrating the main body is a single horizontal slotted opening 38 above a plurality of corresponding vertical slotted openings 39, any combination of which may be used for screw or other mounting of a known tool engaging device 40. The upper hook-shaped member 31 includes a horizontal planar portion 44 and an angled planar member 45 terminating in a free end edge 46. It interconnects with the main body at a curved edge 47.

The lower resilient member 32 includes a generally horizontal portion 50 leading to a camming portion 51 terminating in a free edge 52 opposite a curved edge 53.

Installation and removal of the device 10 from the wallboard panel 11 will be apparent from a consideration of FIGS. 3 and 4. To install the clip, the upper hook-shaped member is inserted into the upper of two parallel adjacent grooves, following which the resilient member is pivoted into engagement with the lower of-the two grooves. The free edge 46 and free edge 52 lie in a plane parallel to a plane which extends through the main body 50, so that once engaged, the main body 50 will lie in spaced parallel relation relative to the surface 12 of the panel 11. This allows adequate space therebetween for the installation of tab or bolt means by which a device such as that indicated by reference character 40 may be permanently installed.

It may thus be seen that I have invented novel and highly useful improvements in a resiliently engaged mounting device which enables the selective mounting upon a grooved wallboard of a variety of tools and implements using supporting devices which are normally permanently attached to a wall surface or building stud. Thus, by the use of my invention, it is possible to conveniently reposition the location of any stored object to enable greater space utilization upon the wall panel, as required.

I wish it to be understood that I do not consider the invention to be limited to the precise details shown and set forth in the specification, for obvious modifications will occur to those skilled in the art to which the invention pertains.

I claim:

1. An improved mounting device for supporting an article upon a vertical building wall panel in which the wall includes a plurality of horizontally oriented dovetail recesses in parallel spaced relation, said device comprising: a unitary, generally "C"-shaped clamp having a planar main body penetrated by through openings in mutually spaced relation, an upper hook-shaped member extending laterally at substantially a right angle from said main body portion, at a first end thereof, and a lower resilient member extending laterally at substantially a right angle from a second end of said main body portion; said clamp being selectively engageable at either end thereof in one of a pair of adjacent dovetail recesses in said wall panel, such that said main body is positioned in spaced parallel relation relative to said wall.

2. A mounting device in accordance with claim 1, further comprising: said main body portion having a plurality of openings extending therethrough for the mounting of a tool engaging supporting device.

3. A mounting device in accordance with claim 1, in which said upper hook-shaped member and said lower resilient member each have rectilinear free edges, said edges lying in a plane lying in spaced parallel relation relative to a plane passing through said main body member.

4. In combination, a building wall panel, said panel having an exposed surface, and a plurality of parallel horizontally oriented dovetail recesses extending from said exposed surface; and a mounting device for supporting articles upon said wall panel, said device including a generally "C"-shaped clamp having a planar main body, an upper hook-shaped member extending at substantially a right angle from said main body at a first end thereof, and a lower resilient member extending at substantially a right angle from a second end of said main body; said clamp being selectively engaged at either end thereof in one of a pair of adjacent dovetail recesses in said wall panel such that said main body is positioned in spaced parallel relation relative to said wall panel.

5. The combination set: forth in claim 4, said main body portion having a plurality of openings extending therethrough for the mounting of a tool engaging supporting device.

6. The combination set forth in claim 4, in which said upper hook-shaped member and said lower resilient member each have rectilinear free edges, said edges lying in a plane in spaced parallel relation relative to a plane passing through said main body.

* * * * *